US008183774B2

(12) United States Patent
Tsuchida

(10) Patent No.: US 8,183,774 B2
(45) Date of Patent: May 22, 2012

(54) FRONT PLATE FOR PLASMA DISPLAY PANEL AND METHOD FOR MANUFACTURING THE SAME, AS WELL AS PLASMA DISPLAY PANEL

(75) Inventor: Shuzo Tsuchida, Nara (JP)

(73) Assignee: Panasonic Corporation, Osaka (JP)

( * ) Notice: Subject to any disclaimer, the term of this patent is extended or adjusted under 35 U.S.C. 154(b) by 385 days.

(21) Appl. No.: 12/524,063

(22) PCT Filed: Dec. 11, 2008

(86) PCT No.: PCT/JP2008/003707

§ 371 (c)(1),
(2), (4) Date: Jul. 22, 2009

(87) PCT Pub. No.: WO2009/101666

PCT Pub. Date: Aug. 20, 2009

(65) Prior Publication Data

US 2011/0221338 A1 Sep. 15, 2011

(30) Foreign Application Priority Data

Feb. 13, 2008 (JP) ..... 2008-031395

(51) Int. Cl.
*H01J 1/62* (2006.01)

(52) U.S. Cl. ..... 313/582; 313/584; 313/586

(58) Field of Classification Search ..... 313/582, 313/584, 586

See application file for complete search history.

(56) References Cited

U.S. PATENT DOCUMENTS

2001/0052958 A1 12/2001 Ogawa

FOREIGN PATENT DOCUMENTS

| | | |
|---|---|---|
| JP | 10-283940 | 10/1998 |
| JP | 2001-356708 | 12/2001 |
| JP | 2007-026960 | 2/2007 |
| JP | 3980462 | 9/2007 |

OTHER PUBLICATIONS

English translation of International Preliminary Report on Patentability and Written Opinion of the international Searching Authority, issued Sep. 7, 2010, in PCT/JP2008/003707 (in English).

*Primary Examiner* — Vip Patel
(74) *Attorney, Agent, or Firm* — Wenderoth, Lind & Ponack, L.L.P.

(57) ABSTRACT

In a front plate for PDP, which includes: a large number of display electrodes formed in stripes on a substrate; a plurality of terminal groups for connection with an external drive circuit, each terminal group being formed along an edge of the substrate, the edge being extended in a direction orthogonal to an extending direction of the display electrode; and a large number of lead electrodes extended from the display electrodes, respectively, in a non-image display region on the substrate to gather toward any one of the terminal groups without intersecting each other, the lead electrodes being connected to corresponding terminals in the relevant terminal group, respectively, further, a large number of strip-shaped aid members for aiding formation of a dielectric layer are formed in a region located between the adjacent terminal groups. Thus, it is possible to make a circumference of a dielectric layer even although a dielectric material to be used is low in viscosity.

28 Claims, 14 Drawing Sheets

A3

B3

C3

FRONT PLATE FOR PLASMA DISPLAY PANEL AND METHOD FOR MANUFACTURING THE SAME, AS WELL AS PLASMA DISPLAY PANEL

TECHNICAL FIELD

The present invention relates to a plasma display panel for use in an image display device and the like. More specifically, the present invention relates to a configuration and a manufacturing method of a non-image display region on an outer periphery of a front plate of the plasma display panel.

BACKGROUND ART

A plasma display panel (hereinafter, referred to as a PDP) allows realization of a high degree of definition and a large screen, and therefore is for use in a large television set having a screen size of, for example, 65 inches or more. Recently, such a PDP has been applied increasingly to a high-definition television set having scanning lines the number of which is more than twice as large as those of a conventionally known television set adopting an NTSC system, and further reduction in cost thereof has been demanded.

A PDP basically includes a front plate and a back plate. The front plate typically includes a front substrate, a large number of display electrodes which are formed in stripes on one side of the front substrate, a dielectric layer which covers the large number of display electrodes and serves as a capacitor, and a dielectric protective layer which is formed on the dielectric layer. On the other hand, the back plate typically includes a back substrate, a large number of address electrodes which are formed in stripes on one side of the back substrate, and a base dielectric layer which covers the large number of address electrodes. Herein, a large number of partition walls are formed in stripes on the base dielectric layer. These partition walls are arranged in parallel with the address electrodes such that each address electrode is located between the adjacent partition walls when being seen in a thickness direction of the back plate. Moreover, the base dielectric layer and side surfaces of the adjacent partition walls form a plurality of grooves coated with a phosphor layer emitting red light, a phosphor layer emitting green light, or a phosphor layer emitting blue light in sequence.

In the PDP, the front plate and the back plate are arranged such that the display electrode formation side and the address electrode formation side face each other. Further, the PDP has an outer periphery sealed with a seal member. That is, the PDP is of an enclosed structure. In this enclosed structure, an enclosed space is formed and is filled with a discharge gas containing neon (Ne), xenon (Xe), and the like at a pressure of 53,000 to 80,000 Pa, so that a discharge space is formed. In the PDP, a video signal voltage is applied selectively to the display electrode, so that gas discharge occurs at the discharge space. Then, ultraviolet rays are generated by the gas discharge, and each phosphor layer is excited by the ultraviolet rays to emit visible light. Thus, a color image can be displayed on the PDP.

In the PDP configured as described above, the display electrodes are led as lead electrodes at predetermined intervals in a non-image display region located on an outer periphery of the front plate. This lead electrode is connected to an electrode of an external drive circuit of the PDP. It is to be noted that the non-image display region to be described herein refers to a region which intends to establish connections with the external drive circuit and the back plate, but does not mainly intend to display an image.

Patent Document 1 (Japanese Patent No. 3980462) discloses one example of the PDP having the configuration described above. In addition to the configuration described above, a conventional PDP disclosed in Patent Document 1 further includes a dummy electrode formed near lead electrodes in a non-image display region on an outer periphery of a front plate.

FIG. 15 shows a positional relation among electrodes formed on the outer periphery of the front plate of the conventional PDP.

As shown in FIG. 15, the front plate includes a front substrate 210, a large number of display electrodes 211 formed in stripes on the front substrate 210, and a large number of lead electrodes 211*a* led from the large number of display electrodes 211, respectively. The lead electrodes 211*a* are formed such that a clearance therebetween becomes narrow gradually, and are connected to corresponding terminals in a plurality of terminal groups 211*b* which are arranged along an edge of the front substrate 210 at predetermined intervals. Moreover, a different terminal 217 and a dummy electrode 218 are formed on a region located between the adjacent terminal groups 211*b* and 211*b*. The dummy electrode 218 is interposed between the different terminal 217 and each of the terminal groups 211*b* and 211*b* to insulate the different terminal 217 from the terminal group 211*b*.

Patent Document 1: Japanese Patent No. 3980462

Recently, a PDP has been subjected to various product developments in order to achieve further reduction in cost thereof. As one of the product developments, a method for forming a dielectric layer is improved for achieving such reduction in cost. Conventionally, a dielectric layer is formed so that a glass frit-containing paste is applied, dried and baked repetitively. According to the improved dielectric layer forming method, a sol with low viscosity, which is a colloid solution made of metal alkoxide, is used as a dielectric material. This sol is solidified by hydrolysis and polycondensation reaction to form a gel. Then, this gel is subjected to heat treatment to obtain an oxide. That is, the dielectric layer is formed by sol-gel reaction. The conventional dielectric layer forming method requires a process of baking the applied paste at a temperature which is not less than a softening point of glass frit. According to the improved dielectric layer forming method, on the other hand, the dielectric layer can be formed at a temperature which is lower than the conventional temperature by virtue of the sol-gel reaction. This improvement allows realization of reduction in manufacturing cost.

In the improved dielectric layer forming method, however, the sol, when being applied onto a front substrate, is apt to flow on the front substrate because of the low viscosity thereof. The flow of the sol depends on presence/absence of an electrode, so that a circumference of the dielectric layer does not become even (linear), but becomes wavy. The wavy circumference of the dielectric layer lowers a sealability of a seal member, leading to degradation in quality of a PDP. With reference to FIG. 16, this point is described in more detail.

FIG. 16 is a partly enlarged plan view showing the front plate of the conventional PDP in a state that a dielectric layer has a wavy circumference. It is to be noted that the front plate shown in FIG. 16 does not include the different terminal 217 and the dummy electrode 218.

It is assumed herein that a sol with low viscosity is used as a dielectric material and a dielectric layer 215 is formed by, for example, a die coat method of applying a sol discharged from a slit die. In such a case, the sol is apt to flow along the display electrode 211 and the lead electrode 211*a*. Herein, the plurality of lead electrodes 211*a* are formed such that a clearance therebetween becomes narrow gradually. As a result, the sol hardly flows toward a region 250 located between the adjacent terminal groups 211*b* and 211*b*. As shown by a dotted line in FIG. 16, consequently, waviness occurs at a circumference of the dielectric layer 215. Herein, there is a possibility that waviness occurs at the circumference of the dielectric layer 215 in a non-image display region (an upper region in FIG. 16) located beside the display electrode 211, depending on viscosity of a sol to be used, process conditions (e.g., an applying pressure, an applying rate) of an application method, and the like.

The wavy circumference of the dielectric layer 215 causes the following problems about a positional relation between the dielectric layer 215 and a seal member.

In the non-image display region on the outer periphery of the front plate, herein, the seal member is attached to the entire circumference of the dielectric layer 215. Thus, the front plate is connected to a back plate through the seal member such that a sealed space is formed between the front plate and the back plate.

As shown in FIG. 17A, most preferably, the dielectric layer 215 and the seal member 218 are arranged such that a part of the seal member 218 comes into contact with the dielectric layer 215 and the remaining part of the seal member 218 comes into contact with the lead electrode 211*a* or the front substrate 210. In contrast to this, as shown in FIG. 17B, if the seal member 218 comes into contact with only the dielectric layer 215, there may occur a sealing leak between the front plate 201 and the back plate 202 because the seal member 218 does not come into close contact with the lead electrode 211*a* or the front substrate 210. As shown in FIG. 17C, moreover, if the seal member 218 does not come into contact with the dielectric layer 215, there may occur a malfunction such as abnormal discharge because the lead electrode 211*a* is bared partly.

Accordingly, the wavy circumference of the dielectric layer 215 causes the disadvantages shown in FIGS. 17B and 17C, resulting in occurrence of the malfunctions such as the sealing leak and the abnormal discharge. In the former case, moreover, the seal member 218 is pressed unevenly at the time when the front plate and the back plate are joined together. This unevenness causes a variation of gaps in the PDP, resulting in degradation in quality of the PDP. In order to avoid these disadvantages, preferably, a waviness width at the circumference of the dielectric layer 215 (i.e., a length between an innermost wavy portion and an outermost wavy portion in the dielectric layer 215) must be suppressed within ±2 mm (i.e., 4 mm).

However, the configuration of the conventional PDP, for example, the PDP disclosed in Patent Document 1 fails to suppress the waviness width at the circumference of the dielectric layer and accordingly fails to avoid the respective malfunctions.

The present invention has been devised to improve the issues described above, and an object thereof is to provide a front plate for PDP, in which a circumference of a dielectric layer can be made even although the dielectric layer is made of a material with low viscosity, and a method for manufacturing the same, as well as a PDP including the front plate.

SUMMARY OF THE INVENTION

In order to achieve the above object, the present invention has the following constitutions.

According to a first aspect of the present invention, there is provided a front plate for plasma display panel, comprising:

a large number of display electrodes formed in stripes on a substrate;

a plurality of terminal groups for connection with an external drive circuit, each terminal group being formed along an edge of the substrate, the edge being extended in a direction orthogonal to an extending direction of the display electrode;

a large number of lead electrodes extended from the display electrodes, respectively, in a non-image display region on the substrate to gather toward any one of the terminal groups without intersecting each other, the lead electrodes being connected to corresponding terminals in the relevant terminal group, respectively; and a large number of strip-shaped aid members for aiding formation of a dielectric layer in a region located between the adjacent terminal groups.

Herein, the phrase "a large number of" in the phrase "a large number of strip-shaped aid members" means a number other than an extremely small number such as one or two.

Moreover, the phrase "a region located between the adjacent terminal groups" means a region including not only a region where the two terminal groups strictly face each other, but also a region near such a region.

According to a second aspect of the present invention, there is provided a front plate for plasma display panel as defined in the first aspect, wherein the aid members are formed in stripes.

According to a third aspect of the present invention, there is provided the front plate for plasma display panel as defined in the first aspect, further comprising:

a second aid member for aiding formation of the dielectric layer having a smoothly curved circumference, formed between the adjacent lead electrodes.

According to a fourth aspect of the present invention, there is provided the front plate for plasma display panel as defined in the third aspect, wherein the circumference of the second aid member has a circular shape or an ellipsoidal shape.

According to a fifth aspect of the present invention, there is provided the front plate for plasma display panel as defined in the first aspect, further comprising:

a large number of strip-shaped third aid members for aiding formation of the dielectric layer, the third aid member being formed in stripes and arranged in substantially parallel with the display electrodes in a non-image display region located between the display electrode and an edge of the substrate, the edge of the substrate being extended in a direction parallel with the extending direction of the display electrode.

According to a sixth aspect of the present invention, there is provided the front plate for plasma display panel as defined in the first aspect, wherein the lead electrode has a structure that at least two or more electrode materials are laminated.

According to a seventh aspect of the present invention, there is provided a front plate for plasma display panel as defined in the first aspect, wherein the aid members are equal in material to the lead electrode.

According to an eighth aspect of the present invention, there is provided the front plate for plasma display panel as defined in the first aspect, further comprising:

a dielectric layer formed on the substrate to cover the display electrode and a part of the lead electrode, wherein the dielectric layer has a structure of a siloxane skeleton in which an alkyl group is bonded to silicon.

According to a ninth aspect of the present invention, there is provided a plasma display panel comprising the front plate for plasma display panel as defined in any one of the first to eighth aspects.

According to a tenth aspect of the present invention, there is provided a method for manufacturing a front plate for plasma display panel, the front plate including: a large number of display electrodes formed in stripes on a substrate; a plurality of terminal groups for connection with an external drive circuit, each terminal group being formed along an edge of the substrate, the edge being extended in a direction orthogonal to an extending direction of the display electrode; a large number of lead electrodes extended from the display electrodes, respectively, in a non-image display region on the substrate to gather toward any one of the terminal groups without intersecting each other, the lead electrodes being connected to corresponding terminals in the relevant terminal group, respectively; and a large number of strip-shaped aid members for aiding formation of a dielectric layer formed in a region located between the adjacent terminal groups, the method comprising forming the lead electrode and the aid member simultaneously in such a manner that an electrode material containing a photosensitive material is exposed to light and is developed.

According to an 11th aspect of the present invention, there is provided the method for manufacturing the front plate for plasma display panel as defined in the tenth aspect, wherein the front plate for plasma displays further includes a dielectric layer formed on the substrate to cover the display electrode and a part of the lead electrode, and comprising forming the dielectric layer by a sol-gel method.

According to a 12th aspect of the present invention, there is provided the method for manufacturing the front plate for plasma display panel as defined in the 11th aspect, comprising forming the dielectric layer by using a dielectric material having a viscosity of 5 to 100 mPa·s.

The front plate for PDP according to the present invention includes the large number of strip-shaped aid members formed in the region, where the dielectric material hardly flows, located between the adjacent terminal groups. Therefore, even in a case where a dielectric material to be used is low in viscosity, the aid member aids the flow of the dielectric material, so that the circumference of the dielectric layer can be made even.

Moreover, the PDP according to the present invention includes the front plate for PDP. In the PDP, therefore, the circumference of the dielectric layer can be made even although a dielectric material to be used is low in viscosity.

Further, the method for manufacturing the front plate for PDP according to the present invention allows simultaneous formation of the lead electrode and the aid member by exposure and development of the electrode material containing the photosensitive material. Therefore, no extra step is required for formation of the aid member, leading to suppression of increase in manufacturing time and manufacturing cost.

BRIEF DESCRIPTION OF THE DRAWINGS

These and other aspects and features of the present invention will become clear from the following description taken in conjunction with the preferred embodiments thereof with reference to the accompanying drawings, in which.

DETAILED DESCRIPTION OF THE INVENTION

Figure 1:
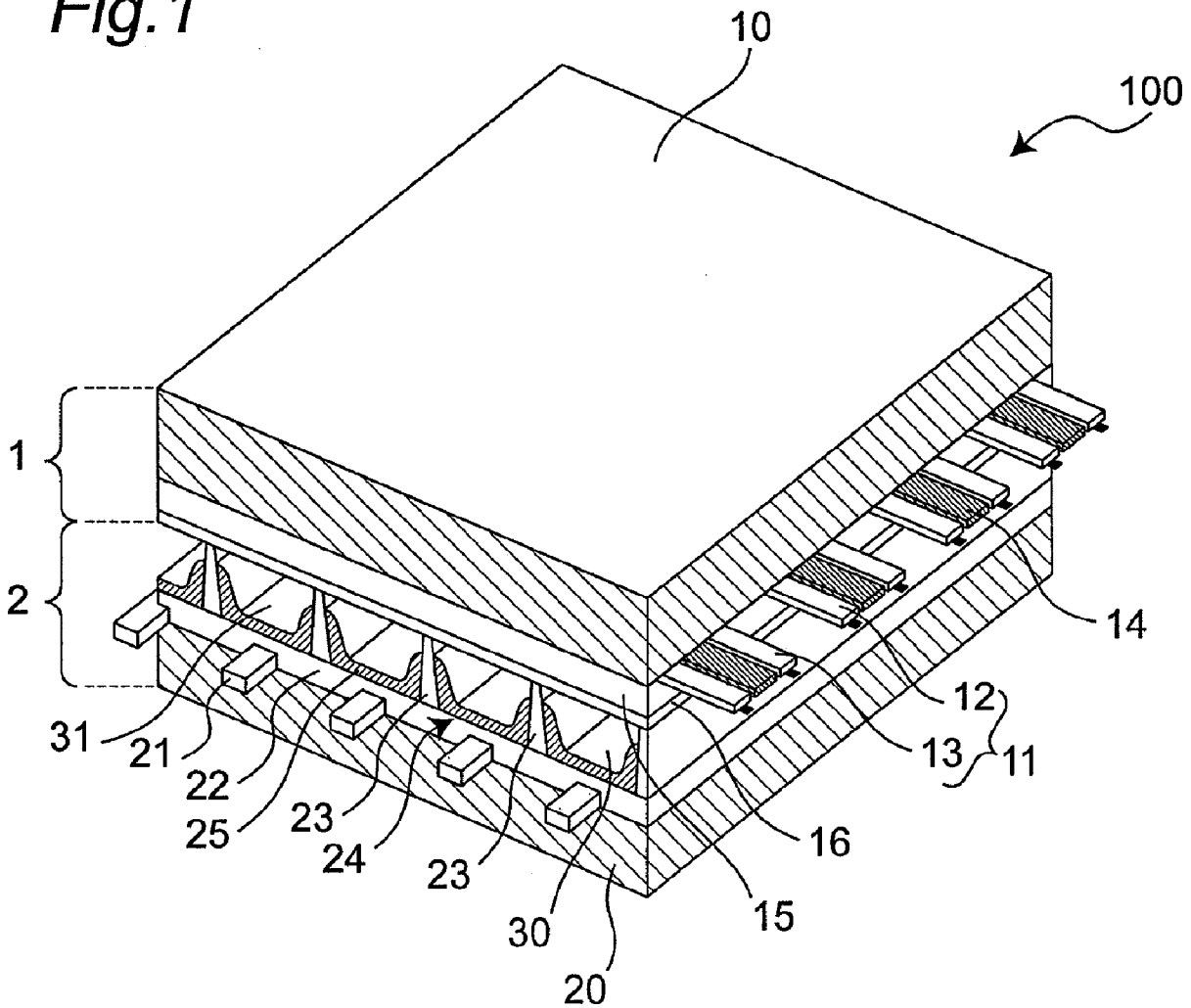
FIG. 1 is a perspective view schematically showing a basic structure of a PDP including a front plate for PDP according to one embodiment of the present invention.

Before the description of the present invention proceeds, it is to be noted that like parts are designated by like reference numerals throughout the accompanying drawings.

With reference to the drawings, hereinafter, detailed description will be given of preferred embodiments of the present invention.

Embodiments

With reference to FIG. 1, description will be given of a basic configuration of a PDP 100 including a front plate for PDP according to one embodiment of the present invention (hereinafter, referred to as a front plate 1). FIG. 1 is a perspective view schematically showing a basic structure of the PDP 100 including the front plate 1 according to the embodiment of the present invention. The basic structure of the PDP 100 in this embodiment is similar to that of a typical PDP of an AC surface discharge type.

As shown in FIG. 1, the PDP 100 includes the front plate 1 and a back plate 2 arranged so as to face the front plate 1. Herein, an outer periphery between the front plate 1 and the back plate 2 is surrounded with a seal member 18 (see FIG. 3) such as glass frit. That is, the PDP 100 is sealed hermetically with the seal member 18, so that a discharge space 30 is formed inside the PDP 100. The discharge space 30 is filled with a discharge gas containing neon (Ne), xenon (Xe) and the like at a pressure of 53,000 to 80,000 Pa.

The front plate 1 includes a front substrate 10 made of glass or the like. The front plate 1 also includes a plurality of strip-shaped display electrodes 11 each configured with a scanning electrode 12 and a sustaining electrode 13, and a plurality of black stripes (also referred to as light shielding layers) 14. The plurality of display electrodes 11 and the plurality of black stripes 14 are formed on one side of the front substrate 10 so as to be arranged in parallel with each other. The front plate 1 also includes a dielectric layer 15 formed on the same side of the front substrate 10 so as to cover the display electrodes 11 and the black stripes 14. Herein, the dielectric layer 15 serves as a capacitor. The front plate 1 also includes a dielectric protective layer 16 formed on the dielectric layer 15 in order to protect the respective electrodes. Herein, the dielectric protective layer 16 is formed so as to cover the dielectric layer 15.

The back plate 2 includes a back substrate 20 made of glass or the like. The back plate 2 also includes a plurality of strip-shaped address electrodes 21 formed on one side of the back substrate 20. Herein, the plurality of address electrodes 21 are arranged in parallel with one another so as to be orthogonal to the plurality of display electrodes 11. The back plate 2 also includes a base dielectric layer 22 formed on the same side the back substrate 20 so as to cover the address electrodes 21. The back plate 2 also includes a plurality of partition walls 23 formed on the base dielectric layer 22 so as to partition the discharge space 30 for the respective address electrodes 21. Herein, each partition wall 23 has a predetermined height in a direction which is parallel with an extending direction of the address electrode 21. The back plate 2 also includes a plurality of groove 24 each formed by the base dielectric layer 22 and side surfaces of the adjacent partition walls 23 and 23. The plurality of grooves 24 are coated with a phosphor layer 25 irradiated with ultraviolet rays to emit red light, a phosphor layer 25 irradiated with ultraviolet rays to emit blue light, or a phosphor layer 25 irradiated with ultraviolet rays to emit green light in sequence.

In the configuration described above, discharge cells 31 are formed at intersections of the display electrodes 11 and the address electrodes 21, respectively. That is, the discharge cells 31 are arranged in a matrix form. Each discharge cell 31 serves as an image display region in the PDP 100. Herein, three discharge cells 31 arranged in an extending direction of the display electrode 11, that is, the discharge cell 31 having the phosphor layer 25 emitting red light, the discharge cell 31 having the phosphor layer 25 emitting green light and the discharge cell 31 having the phosphor layer 25 emitting blue light constitute a pixel for color display.

For example, an external drive circuit provided outside the PDP 100 applies in sequence various drive signals to a position between the scanning electrode 12 and the address electrode 21 and a position between the scanning electrode 12 and the sustaining electrode 13, so that gas discharge occurs at each discharge cell 31, which causes generation of ultraviolet rays. The ultraviolet rays generated as described above in the respective discharge cells 31 excite the phosphor layers 25 corresponding to the discharge cells 31, so that each phosphor layer 25 emits visible light. Thus, the PDP 100 can display a color image.

Figure 2:
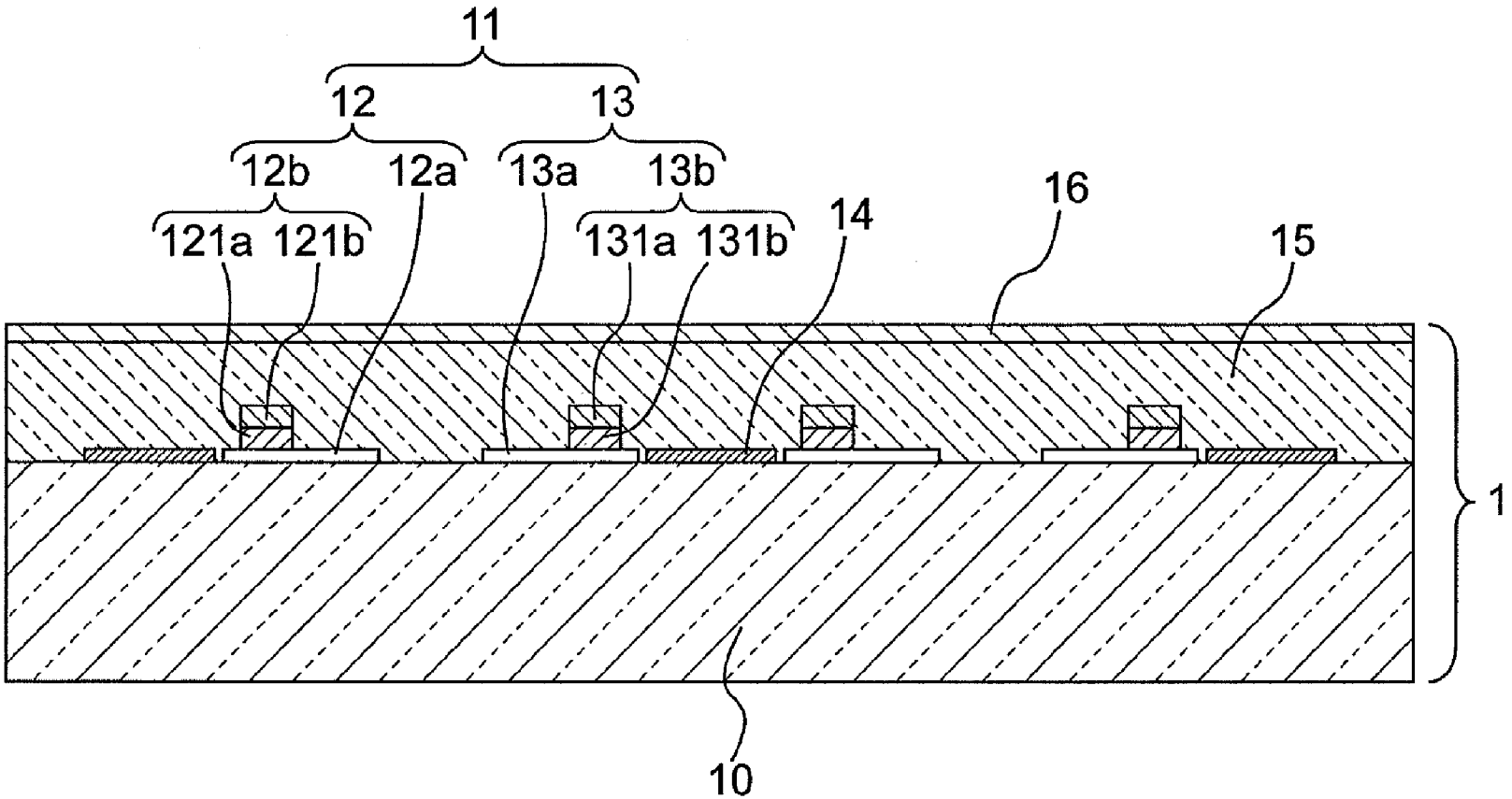
FIG. 2 is a sectional view showing a basic configuration of the front plate for PDP according to the embodiment of the present invention.
Figure 3:
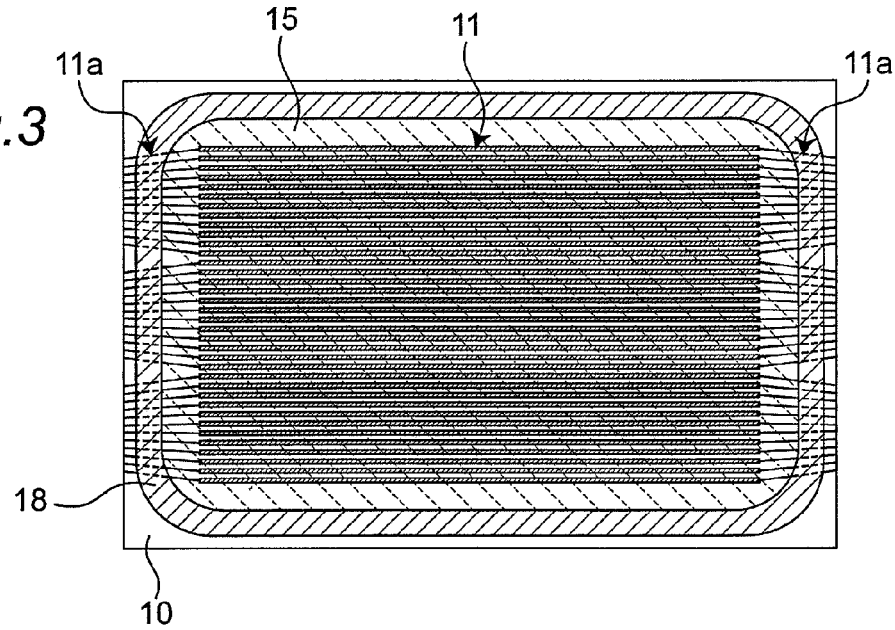
FIG. 3 is a plan view showing a state that a circumference of a dielectric layer is surrounded with a seal member in the front plate for PDP according to the embodiment of the present invention.
Figure 4:
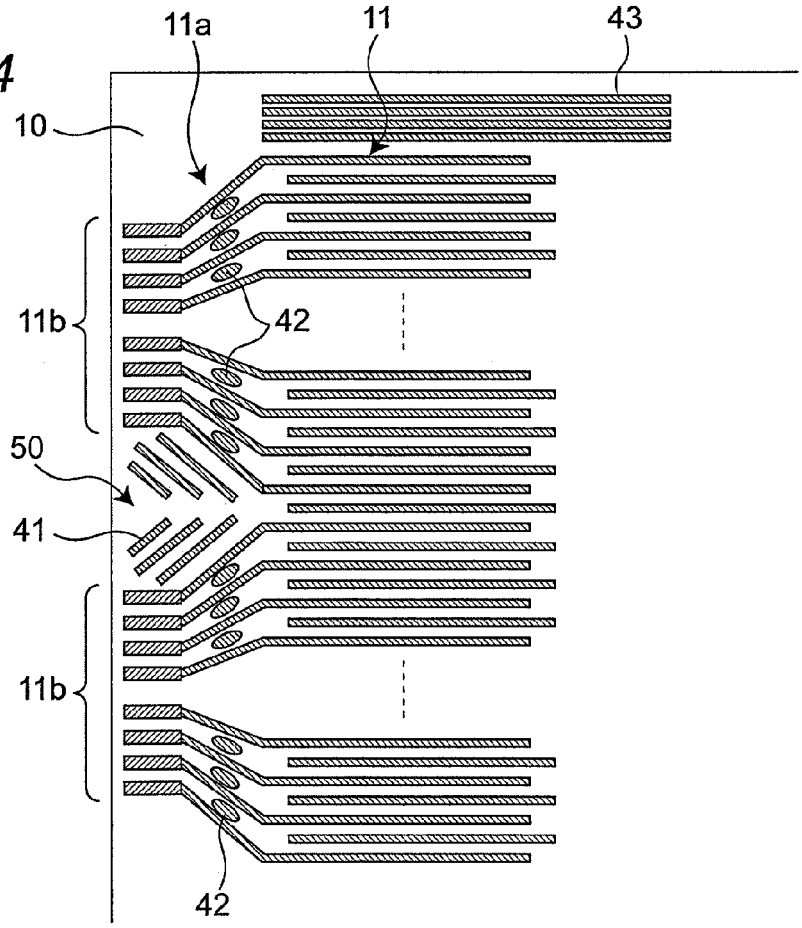
FIG. 4 is a view showing a positional relation between electrodes and dummy electrodes at an outer periphery of the front plate for PDP according to the embodiment of the present invention.

With reference to FIG. 2 to FIG. 4, next, the configuration of the front plate 1 is described in more detail. FIG. 2 is a sectional view showing the basic configuration of the front plate 1 according to the embodiment of the present invention. In FIG. 2, the front plate 1 is shown while being turned upside down, unlike FIG. 1. FIG. 3 is a plan view showing the front plate 1 in which a circumference of the dielectric layer 15 is surrounded with the seal member 18. FIG. 4 is a plan view partly showing the configuration at the outer periphery of the front plate 1 from which the dielectric layer 15 and the dielectric protective layer 16 are removed.

In FIG. 2, the front substrate 10 is made of a glass material such as sodium borosilicate glass by a float process, for example. The pattern of the black stripe 14 and the display electrode 11 configured with the scanning electrode 12 and the sustaining electrode 13 is formed on the front substrate 10. The scanning electrode 12 is configured with a transparent electrode 12*a* and a metal bus electrode 12*b* formed on the transparent electrode 12*a*, and the sustaining electrode 13 is configured with a transparent electrode 13*a* and a metal bus electrode 13*b* formed on the transparent electrode 13*a*. Each of the transparent electrodes 12*a* and 13*a* is made of indium oxide (ITO), tin oxide ($SnO_2$), or the like. The metal bus electrodes 12*b* and 13*b* are used for imparting conductivity to the transparent electrodes 12*a* and 13*a*, respectively, in a longitudinal direction. Each of the metal bus electrodes 12*b* and 13*b* is made of a conductive material composed mainly of a silver (Ag) material. Moreover, the metal bus electrode 12*b* is configured with a black electrode 121*b* and a white electrode 121*a*, and the metal bus electrode 13*b* is configured with a black electrode 131*b* and a white electrode 131*a*.

Moreover, the dielectric layer 15 is formed on the front substrate 10 so as to cover the transparent electrodes 12*a* and 13*a*, the metal bus electrodes 12*b* and 13*b*, and the black stripe 14. The dielectric layer 15 is formed by use of a sol with low viscosity which is a colloid solution made of metal alkoxide as a dielectric material. The sol is solidified by hydrolysis and polycondensation reaction to form a gel. Then, the gel is subjected to heat treatment to obtain an oxide. That is, the dielectric layer 15 is formed by sol-gel reaction. For example, the dielectric material may be a sol having a siloxane skeleton in which an alkyl group is bonded to silicon. The dielectric layer 15 formed as described above has a structure of a siloxane skeleton in which an alkyl group is bonded to Si. Moreover, the dielectric protective layer 16 is formed on the dielectric layer 15. The dielectric protective layer 16 is made of magnesium oxide (MgO) and the like, for example.

Figure 17A:
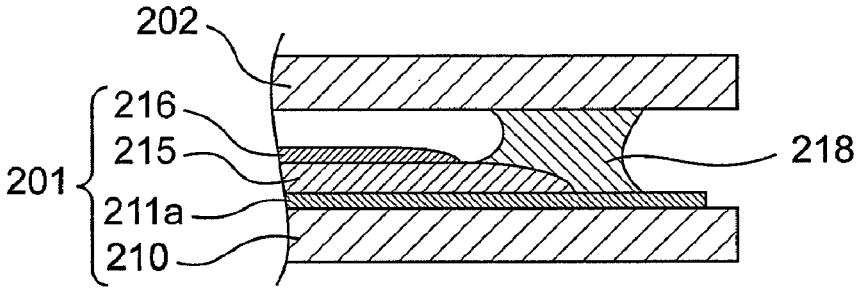
FIG. 17A is a partly enlarged sectional view showing the PDP in which a seal member and the dielectric layer are in a favorable positional relation.
Figure 17B:
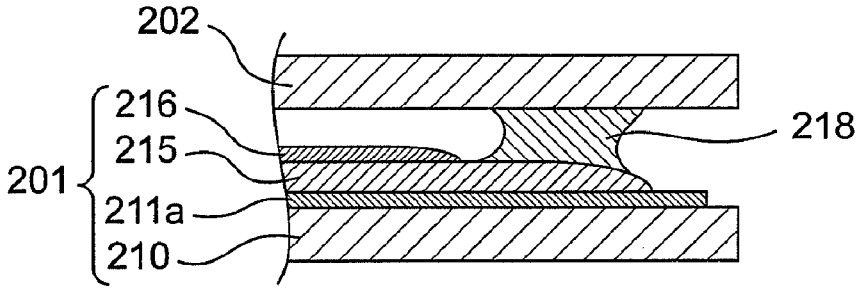
FIG. 17B is a partly enlarged sectional view showing the PDP in which the seal member and the dielectric layer are in an unfavorable positional relation.
Figure 17C:
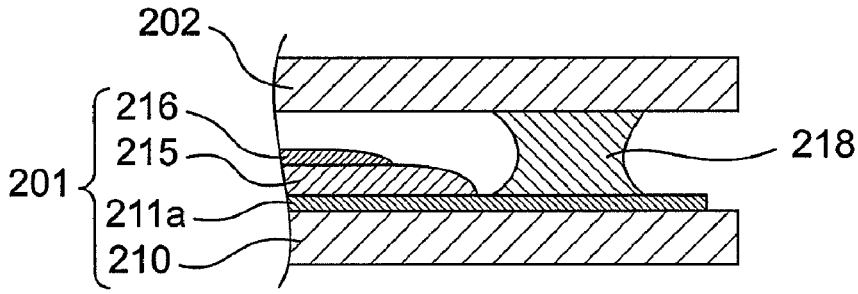
FIG. 17C is a partly enlarged sectional view showing the PDP in which the seal member and the dielectric layer are in an unfavorable positional relation which is different from that shown in FIG. 17B.

As shown in FIG. 3, the circumference of the dielectric layer 15 is surrounded with the seal member 18 in the state that the front plate 1 is laminated on the back plate 2. As described above (see FIG. 17A), most preferably, the dielectric layer 15 and the seal member 18 are in such a positional relation that a part of the seal member 18 comes into contact with the dielectric layer 15 and the remaining part of the seal member 18 comes into contact with the front substrate 10 or a lead electrode 11*a* led from the display electrode 11. In order to secure this positional relation, a non-image display region on the outer periphery of the front plate 1 (e.g., a region that falls within a range of about 1 to 30 mm from the edge of the front substrate 10) is configured as described later in this embodiment.

As shown in FIG. 4, the lead electrodes 11*a*, . . . and 11*a* are led from the large number of display electrodes 11, . . . and 11 formed in stripes, respectively. The respective lead electrodes 11*a*, . . . and 11*a* extend toward a plurality of terminal groups 11*b*, . . . and 11*b* which are arranged along the edge of the front substrate 10 extending in a direction orthogonal to the extending direction of the display electrode 11 such that a clearance therebetween becomes gradually narrow toward the plurality of terminal groups 11*b*, . . . and 11*b*. The lead electrodes 11*a*, . . . and 11*a* are connected electrically to corresponding terminals in the plurality of terminal groups 11*b*, . . . and 11*b*, respectively. Herein, a line width of each lead electrode 11*a* is 40 to 130 μm, and the clearance between the lead electrodes 11*a* and 11*a* is 400 to 700 μm, for example. The number of terminals in the plurality of terminal groups 11*b*, . . . and 11*b* is equal to the number of lead electrodes 11*a*, . . . and 11*a*.

The plurality of terminal groups 11*b*, . . . and 11*b* are arranged with a predetermined clearance being provided therebetween, and a large number of first dummy electrodes 41 each of which is one example of a strip-shaped aid member for aiding formation of the dielectric layer are formed in stripes on the clearance region 50. Moreover, a second dummy electrode 42 which is one example of a second aid member for aiding formation of the dielectric layer is formed between the adjacent lead electrodes 11*a* and 11*a*. Herein, the second dummy electrode 42 has a smoothly curved circumference (e.g., a circular shape, an ellipsoidal shape). Further, a large number of third dummy electrodes 43 each of which is one example of a strip-shaped third aid member for aiding formation of the dielectric are formed in stripes in a non-image display region (an upper side in FIG. 4) located between the display electrode 11 and the edge of the front substrate 10, the edge of the substrate being extended in a direction parallel with the extending direction of the display electrode 11.

The first to third dummy electrodes 41 to 43 are equal in material to the lead electrode 11*a* and are almost equal in thickness to one another. Moreover, the first to third dummy electrodes 41 to 43 have no electrical connection with the lead electrode 11*a* and the terminal group 11*b*. Further, the first dummy electrode 41 is arranged to facilitate a flow of a dielectric material. On the other hand, the second and third dummy electrodes 42 and 43 are arranged to suppress the flow of the dielectric material. Thus, the circumference of the dielectric layer 15 is not made wavy, but is made even. Specific and preferable configurations and arrangement of the first to third dummy electrodes 41 to 43 for producing such functional effects will be described later in detail.

With reference to FIG. 1 to FIG. 4, next, description will be given of a specific example of a method for manufacturing the PDP 100.

First, description will be given of a method for manufacturing the front plate 1. Herein, the lead electrode 11*a*, the terminal group 11*b*, and the first to third dummy electrodes 41 to 43 are equal in material and forming method to the display electrode 11, and are formed simultaneously with the display electrode 11. In the following, accordingly, description will be given of only the method for forming the display electrode 11.

First, the black stripe 14 and the strip-shaped display electrode 11 configured with the scanning electrode 12 and the sustaining electrode 13 are formed on the front substrate 10.

As shown in FIG. 2, more specifically, the transparent electrodes 12*a* and 13*a*, and the black stripe 14 are formed on the front substrate 10. Thereafter, the metal bus electrode 12*b* is formed on a part of the transparent electrode 12*a* and the metal bus electrode 13*b* is formed on a part of the transparent electrode 13*a*. Thus, the black stripe 14 and the strip-shaped display electrode 11 configured with the scanning electrode 12 and the sustaining electrode 13 are formed on the front substrate 10.

The transparent electrodes 12*a* and 13*a* and the metal bus electrodes 12*b* and 13*b* are formed by patterning using a photolithography method and the like. The transparent electrodes 12*a* and 13*a* are formed in such a manner that a film is formed by a thin film process and the like and then is subjected to patterning using the photolithography method. The metal bus electrodes 12*b* and 13*b* and the black stripe 14 are formed in such a manner that a film, which is made of a paste containing conductive particles and a black pigment, is subjected to patterning using a photolithographic method and then is solidified while being baked at a desired temperature.

Hereinafter, description will be given of a typical example of a specific procedure of forming the metal bus electrodes 12*b* and 13*b* and the black stripe 14. First, the black stripe 14 is formed as follows. That is, a paste, which contains a black pigment and the like, is printed on the front substrate 10, on which the transparent electrodes 12*a* and 13*a* are formed previously, by a screen print method and the like and then is dried. Next, the paste is subjected to patterning using a photolithography method. Subsequently, the metal bus electrode 12*b* configured with the black electrode 121*b* and the white electrode 121*a* and the metal bus electrode 13*b* configured with the black electrode 131*b* and the white electrode 131*a* are formed as follows. That is, a paste, which contains a black pigment, conductive particles and the like and is used for forming the black electrode, is printed on the black stripe 14 by a screen print method and the like and then is dried. Next, a paste, which contains conductive particles (e.g., silver (Ag), platinum (Pt)) and the like and is used for forming the white electrode, is printed on the paste by a screen print method and the like and then is dried. Next, these pastes are subjected to patterning using a photolithography method. Herein, the white electrodes 121*a* and 131*a* are formed on the black electrodes 121*b* and 131*b* (on the front substrate 10 side) in order to improve a contrast ratio of an image to be displayed.

Herein, the black stripe 14 may be equal in material to the black electrodes 121*b* and 131*b* of the metal bus electrodes 12*b* and 13*b*. In such a case, however, the black stripe 14 contains a conductive material; therefore, consideration must be given to occurrence of erroneous discharge upon display of an image.

Next, the dielectric layer 15 is formed by sol-gel reaction so as to cover the display electrode 11 and the black stripe 14.

More specifically, the dielectric layer 15 is formed as follows. That is, a sol, which is used for forming the dielectric layer 15, is diluted with an organic solvent such as alcohol, is applied by a die coat method and the like onto the front substrate 10 so as to cover the display electrode 11 and the black stripe 14, and is left for a predetermined period of time (e.g., within about one minute). Thus, a surface of the applied sol is subjected to leveling and then is flattened. Next, a gel is formed in such a manner that the sol is solidified by hydrolysis and polycondensation reaction. Next, the gel is dried while being subjected to heat for a predetermined period of time at a temperature of 50 to 400° C.

Herein, the sol may be a sol having a siloxane skeleton in which an alkyl group is bonded to silicon, for example. Moreover, the sol may be combined as the alkyl group with an aliphatic group or an aromatic group in order to adjust a thickness, an optical property, and the like. When the sol is applied in a thickness of about 10 to 300 μm, the obtained dielectric layer 15 has a thickness of about 0.1 to 30 μm. In order to obtain the dielectric layer 15 having a desired thickness, accordingly, the foregoing application step is executed plural times. Further, the sol may be mixed with a glass powder or a solvent if necessary in order to adjust the thickness and viscosity.

Next, the dielectric protective layer 16 is formed on the dielectric layer 15 by a vacuum evaporation method, a print method, a die coat method, and the like.

Through the foregoing steps, the front plate 1 is completed in such a state that predetermined constituent members are formed on the front substrate 10.

Next, description will be given of a method for manufacturing the back plate 2.

First, the address electrode 21 is formed as follows. That is, a material layer for forming the address electrode 21 is formed on the back substrate 20 so that a paste containing a silver (Ag) material is screen printed or a metal film is formed entirely and then is subjected to patterning using a photolithography method. Next, the material layer is baked at a desired temperature.

Next, the base dielectric layer 22 is formed as follows. That is, a dielectric paste layer is formed so that a dielectric paste is applied by a die coat method and the like onto the back substrate 20, on which the address electrode 21 is formed, so as to cover the address electrode 21. Next, the dielectric paste layer is baked. Herein, the dielectric paste contains a dielectric material such as a glass powder, a binder, and a solvent.

Next, the partition wall 23 is formed as follows. That is, a partition wall material layer is formed so that a partition wall forming paste containing a partition wall material is applied onto the base dielectric layer 22 and then is subjected to patterning so as to have a predetermined shape. Next, the partition wall material layer is baked. Herein, the partition wall forming paste applied onto the base dielectric layer 22 may be subjected to patterning using a photolithography method and a sand blast method.

Next, the phosphor layer 25 is formed as follows. That is, a phosphor paste layer is formed so that a phosphor paste containing a phosphor material is applied onto the groove 24 formed between the adjacent partition walls 23. Next, the phosphor paste layer is baked.

Through the foregoing steps, the back plate 2 is completed in such a state that predetermined constituent members are formed on the back substrate 20.

Next, the front plate 1 including the predetermined constituent members and the back plate 2 including the predetermined constituent members are arranged so as to face each other with the scanning electrode 12 and the address electrode 21 being orthogonal to each other. Next, the discharge space 30 is formed so that the outer periphery of this laminate is sealed with the seal member 18 such as glass frit. Next, the discharge space 30 is filled with a discharge gas containing neon (Ne), xenon (Xe), and the like. Thus, the PDP 100 is completed.

Next, the method for forming the metal bus electrodes 12*b* and 13*b* of the front plate 1 is described in more detail.

First, a glass material having the following composition is prepared as a material for the black electrodes 121*b* and 131*b*. The glass material contains, as a basic component, 15 to 40 wt % of bismuth oxide ($Bi_2O_3$), 3 to 20 wt % of silicon oxide ($SiO_2$), and 10 to 45 wt % of boron oxide ($B_2O_3$). The glass material also contains an additive such as transition metal in order to adjust a softening point and a color of an electrode. Herein, there is a possibility that a large content of the glass material causes uneven vitrification. For this reason, effectively, the content is adjusted in accordance with a situation.

Next, an electrode glass powder is prepared so that the glass material having the composition and the component described above is pulverized by a wet jet mill or a ball mill such that a mean grain size thereof falls within a range of 0.5 to 2.5 μm. Next, an electrode paste for die coat or for print is prepared so that 15 to 30 wt % of the electrode glass powder, 10 to 45 wt % of a binder component and 5 to 15 wt % of a black pigment are kneaded sufficiently by a three-roll machine.

Herein, the binder component is ethylene glycol containing 5 to 25 wt % of acryl resin, and contains not more than 5 wt % of a photosensitive initiator. Moreover, the electrode paste may contain, as a plasticizer, dioctyl phthalate, dibutyl phthalate, triphenyl phosphate, and tributyl phosphate and may also contain, as an emulsifier, glycerol monoleate, sorbitan sesquioleate, HOMOGENOL (product name (registered trademark), made by Kao Corporation), phosphoric ester containing alkyl-aryl groups, and the like if necessary in order to improve printability.

On the other hand, a glass material having the following composition is prepared as a material for the white electrodes 121*a* and 131*a*. The glass material contains, as a basic component, 15 to 40 wt % of bismuth oxide ($Bi_2O_3$), 3 to 20 wt % of silicon oxide ($SiO_2$), and 10 to 45 wt % of boron oxide ($B_2O_3$). The glass material also contains, as a conductive material, transition metal such as Ag, Pt, or Au in order to ensure conductivity. Herein, there is a possibility that a large content of the glass material causes uneven vitrification. For this reason, effectively, the content is adjusted in accordance with a situation.

As in the case of the black electrodes 121*b* and 131*b*, next, an electrode glass powder is prepared so that the glass material having the composition and the component described above is pulverized by a wet jet mill or a ball mill such that a mean grain size thereof falls within a range of 0.5 to 2.5 μm. Next, an electrode paste for die coat or for print is prepared so that 0.5 to 20 wt % of the electrode glass powder, 1 to 20 wt % of a binder component, and 50 to 85 wt % of conductive particles such as Ag or Pt are kneaded sufficiently by a three-roll machine.

Herein, the binder component is ethylene glycol containing 1 to 20 wt % of acryl resin, and contains not more than 5 wt % of a photosensitive initiator. Moreover, the electrode paste may contain, as a plasticizer, dioctyl phthalate, dibutyl phthalate, triphenyl phosphate, and tributyl phosphate and may also contain, as an emulsifier, glycerol monoleate, sorbitan sesquioleate, HOMOGENOL (product name (registered trademark), made by Kao Corporation), phosphoric ester containing alkyl-aryl groups, and the like if necessary in order to improve printability.

Next, the respective electrode pastes prepared as described above are applied onto or printed on the front substrate 10 by a die coat method or a screen print method and then are dried. Next, the resultant pastes are exposed to light in an amount of 50 to 500 mj/cm$^2$ by use of an exposure mask in a predetermined area. Next, the resultant pastes are developed with an alkali solution such as 0.1 to 10 wt % of an alkali solution. Thus, the metal bus electrode 12*b* and 13*b* are formed by patterning.

As described above, in the case where the black stripe 14 is equal in material to the black electrodes 121*b* and 131*b*, the black stripe 14 can also be formed by patterning.

Moreover, the lead electrodes 11*a*, the terminal groups 11*b* and the first to third dummy electrodes 41 to 43 can be formed by use of an exposure mask having openings formed at positions corresponding thereto. In other words, the first to third dummy electrodes 41 to 43 can be formed together with the remaining electrodes with no extra steps of forming the first to third dummy electrodes 41 to 43. Accordingly, it is possible to reduce a manufacturing cost for the PDP 100.

Next, description will be given of the preferable configuration and arrangement of the first and second dummy electrodes 41 and 42 in detail.

First, the following studies were made for examining a preferable clearance between the arranged first dummy electrodes 41.

Figure 5:
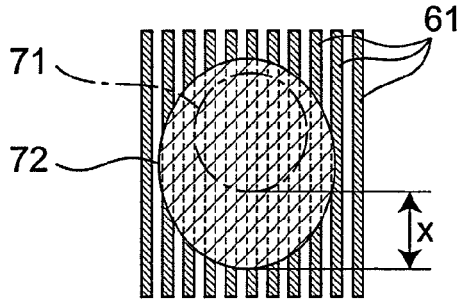
FIG. 5 is a view showing spread of a solution dropped on strip-shaped dummy electrodes formed in stripes.
Figure 6A:
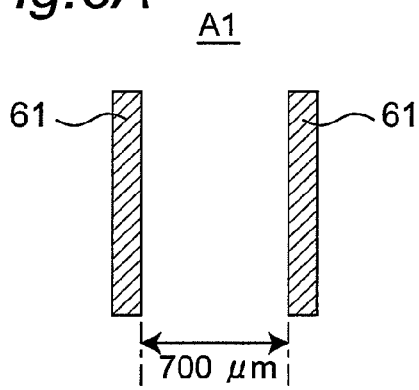
FIG. 6A is a view showing the strip-shaped dummy electrodes arranged with a clearance of 700 μm being interposed therebetween.
Figure 6B:
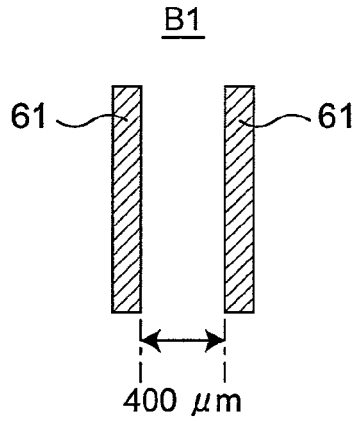
FIG. 6B is a view showing the strip-shaped dummy electrodes arranged with a clearance of 400 μm being interposed therebetween.
Figure 6C:
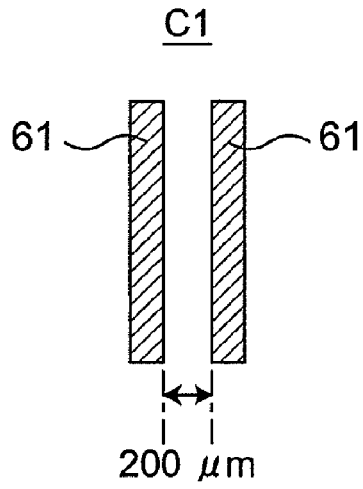
FIG. 6C is a view showing the strip-shaped dummy electrodes arranged with a clearance of 200 μm being interposed therebetween.

Herein, the two layers, that is, the black electrode and the white electrode were printed by a screen print method. Next, a predetermined range thereof was exposed to light in an amount of 100 to 500 mj/cm$^2$, was developed with 0.1 to 10 wt % of a sodium carbonate solution, and was baked at a temperature of not less than 500° C. As shown in FIG. 5, thus, a large number of strip-shaped dummy electrodes 61 were formed in stripes. As shown in FIGS. 6A to 6C, moreover, there were prepared three types of clearances between the arranged dummy electrodes 61, that is, a type A1 for which the clearance is 700 μm, a type B1 for which the clearance is 400 μm, and a type C1 for which the clearance is 200 μm.

Next, a dielectric material for forming the dielectric layer 15 was dropped in an amount of about 1 mL on the dummy electrodes 61, . . . and 61. After a lapse of a predetermined period of time, spread of the dielectric material was observed. The dielectric material to be used herein was a solution that contains a sol having a siloxane skeleton in which an alkyl group is bonded to silicon, and a solvent such as alcohol and has a viscosity adjusted so as to fall within a range of 5 to 100 mPa·s. Hereinafter, such a dielectric material is referred to as a sol-containing solution. In FIG. 5, a portion 71 shown by a chain line indicates the dropped sol-containing solution, and a portion 72 shown by a solid line indicates the spread of the sol-containing solution after the lapse of the predetermined period of time.

Figure 8:
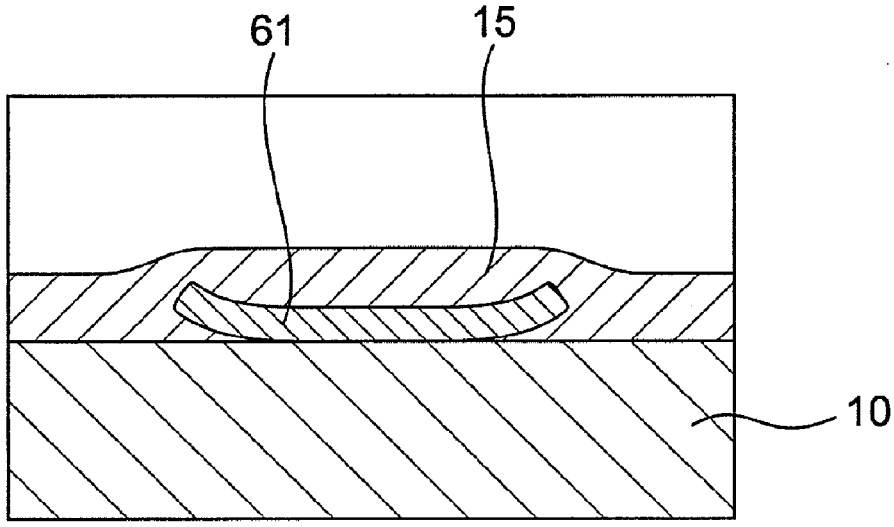
FIG. 8 is a view showing a sectional shape of the strip-shaped dummy electrode which is equal in material and forming method to a display electrode.

It is apparent from FIG. 5 that the sol-containing solution is apt to flow in a direction parallel with an extending direction of the dummy electrode 61. It is considered that the reason therefor results from a capillary phenomenon occurring at the clearance between the dummy electrodes 61 and 61. As shown in FIG. 8, moreover, the dummy electrode 61, which is formed on the front substrate 10 with the material and by forming method therefor being equal to the display electrode 11 according to this embodiment, has a circumference which is warped so as to be spaced away from the front substrate 10 when being seen in a section. Therefore, a small space is formed between the circumference of the dummy electrode 61 and the front substrate 10. It is considered that this small space further facilitates the capillary phenomenon and, as a result, the sol-containing solution becomes apt to flow in the direction parallel with the extending direction of the dummy electrode 61.

Moreover, the sectional shape of the dummy electrode 61 shown in FIG. 8 becomes conspicuous in a case where an electrode to be used has a structure of not less than two layers. For this reason, in the conventional display electrode 211 having the two-layer structure of the black electrode and the white electrode, the dielectric material is apt to flow along the extending direction of the display electrode 211. As described above, consequently, it is considered that a wavy portion is formed widely on the circumference of the dielectric layer 215.

Figure 7:
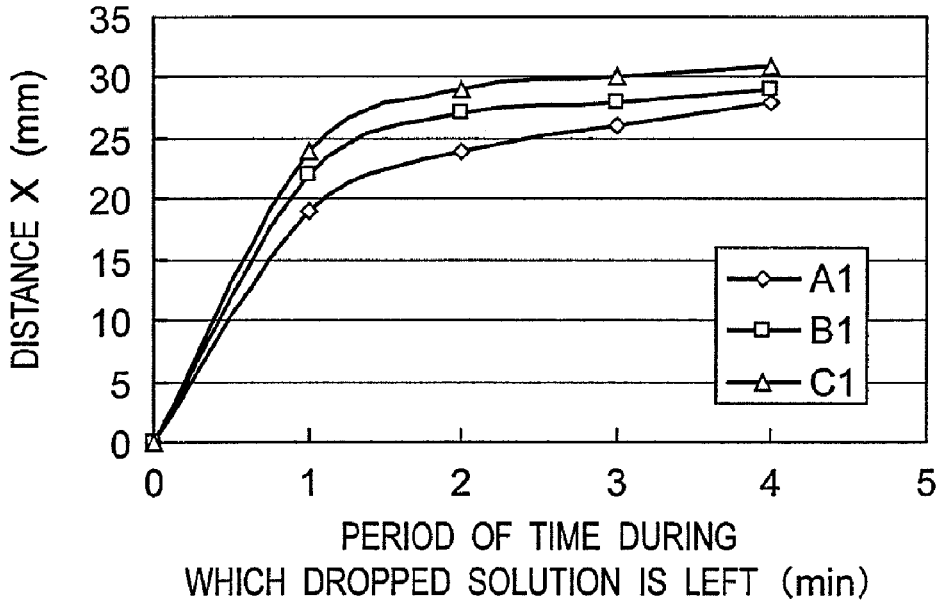
FIG. 7 is a graph showing a relation between a distance of the spread solution and a period of time during which the dropped solution is left, in the arrangements shown in FIGS. 6A to 6C.

FIG. 7 is a graph showing a relation between a distance X of the sol-containing solution displaced in the direction parallel with the extending direction of the dummy electrode 61 and a period of time during which the dropped sol-containing solution is left, in the types A1 to C1.

Figure 9:
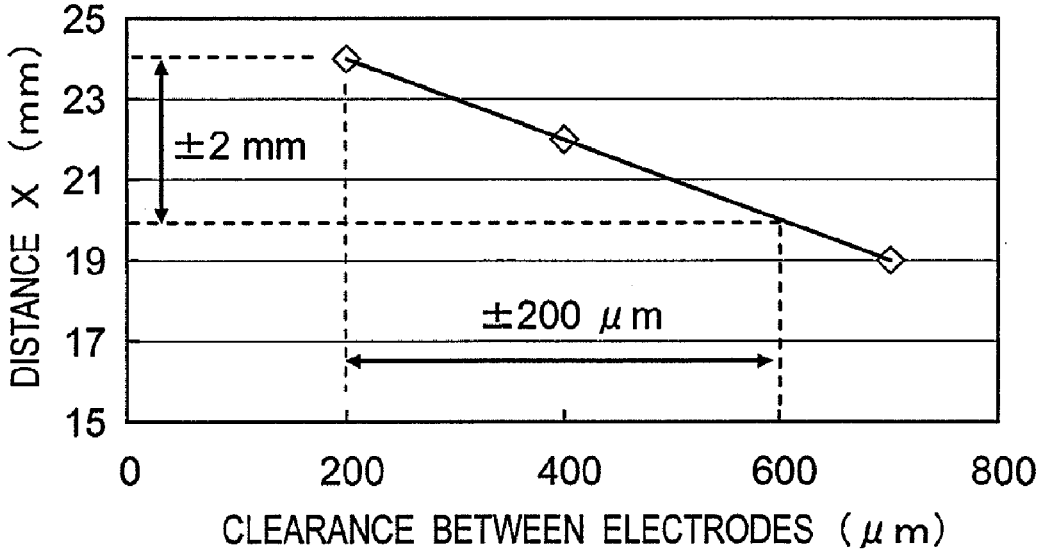
FIG. 9 is a graph showing a relation between the distance of the spread solution shown in FIG. 5 and the clearance between the arranged strip-shaped dummy electrodes.

It is apparent from FIG. 7 that a spreading speed of the sol-containing solution varies depending on the clearance between the arranged dummy electrodes 61 and 61. Herein, the process of heating and drying the sol-containing solution applied onto the front substrate 10 in order to form the display electrode 11 is typically carried out within about one minute since the sol-containing solution is dropped. For this reason, FIG. 9 shows a relation between a distance X of the sol-containing solution displaced after one minute since the sol-containing solution is dropped and the clearance between the arranged dummy electrodes 61 and 61.

As described above, it is desirable that the wavy circumference of the dielectric layer 15 has a width suppressed within a range of ±2 mm (i.e., 4 mm). More specifically, it is apparent from FIG. 9 that the clearance between the dummy electrodes 61 must be set to 200 to 600 μm (i.e., 400±200 μm) in order to suppress the waviness width of the sol-containing solution for forming the dielectric layer 15 within 4 mm on the assumption that a center value is set to 400 μm. That is, it is preferable that the dummy electrodes 61 are arranged with the clearance therebetween being maintained at ±200 μm relative to the clearance between the lead electrodes 11*a*.

Taking the studies described above into consideration, it is preferable that the first dummy electrodes 41 are arranged as follows in this embodiment.

That is, the clearance between the lead electrode 11*a* and the first dummy electrode 41 which adjoin each other and the clearance between the adjacent first dummy electrodes 41 are set within a range of ±200 μm relative to the clearance between the lead electrodes 11*a*. For example, in a case where the clearance between the lead electrodes 11*a* is 500 μm, the clearance between the lead electrode 11*a* and the first dummy electrode 41 which adjoin each other and the clearance between the adjacent first dummy electrodes 41 are set within a range of 500±200 μm (300 to 700 μm). Herein, the lead electrode 11*a* and the first dummy electrode 41 which adjoin each other are not necessarily in parallel with each other and, also, the adjacent first dummy electrodes 41 are not necessarily in parallel with each other as long as the clearance can be ensured within the range described above.

Herein, the minimum number of first dummy electrodes 41 for realizing the stripe pattern depends on the viscosity of the sol-containing solution, the widths of the lead electrode 11*a* and the first dummy electrode 41, the clearances between the lead electrodes 11*a* and between the first dummy electrodes 41, and the like, but is not an order of an extremely small number such as one or two at least. It is preferable that the first dummy electrodes 41 are formed in stripes over the entire region between the adjacent terminal groups 11*a* and 11*a*.

As described above, on the other hand, in the case where the first dummy electrode 41 is equal in material and forming method to the display electrode 11, there is a possibility that a patterning property becomes poor owing to chipping or peeling if the first dummy electrode 41 has a width which is smaller than 30 μm. Moreover, if the first dummy electrode 41 has a width which is larger than 150 μm, a contact area between the seal member 18 on the first dummy electrode 41 and the front substrate 10 can not be ensured satisfactorily, resulting in degradation in adhering property of the seal member 18. In order to avoid the disadvantages described above, it is preferable that the width of the first dummy electrode 41 is not less than 30 μm to not more than 150 μm.

Next, the following studies were made for examining the preferable configuration and arrangement of the second dummy electrode 42.

Figure 10A:
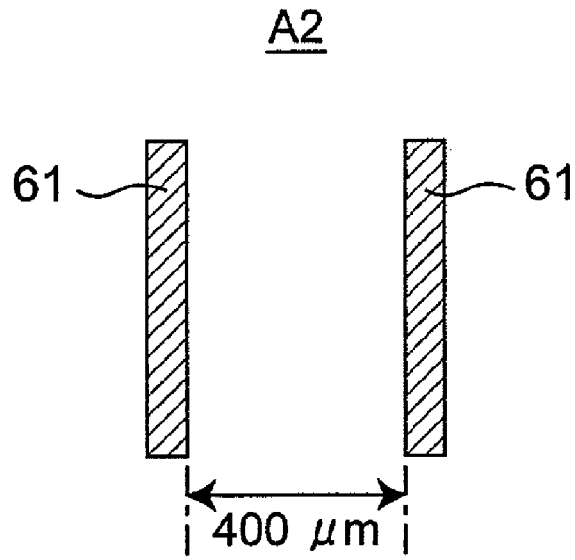
FIG. 10A is a view showing the strip-shaped dummy electrodes with a clearance of 400 μm being interposed therebetween.
Figure 10B:
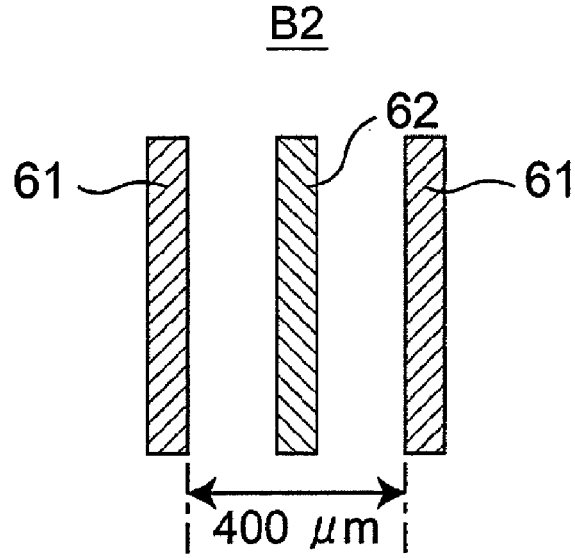
FIG. 10B is a view showing the strip-shaped dummy electrodes with the clearance of 400 μm being interposed therebetween and a different strip-shaped dummy structure formed on the clearance.
Figure 10C:
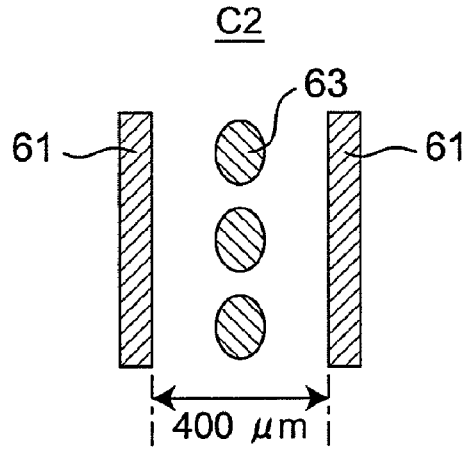
FIG. 10C is a view showing the strip-shaped dummy electrodes with the clearance of 400 μm being interposed therebetween and an ellipsoidal dummy structure formed on the clearance.

Herein, the large number of dummy electrodes 61 each assumed as the lead electrode 11*a* were formed in stripes as shown in FIG. 5. As shown in FIGS. 10A to 10C, moreover, the clearance between the dummy electrodes 61 was set to about 400 μm. Herein, there were prepared three types, that is, types A2 to C2 shown in FIGS. 10A to 10C. The type A2 is such that no member is formed between the adjacent dummy electrodes 61 and 61. The type B2 is such that a strip-shaped dummy electrode 62 is formed between the adjacent dummy electrodes 61 and 61. The type C2 is such that ellipsoidal dummy electrodes 63 are formed between the adjacent dummy electrodes 61 and 61.

Herein, the dummy electrode 62 shown in FIG. 10B had a width set to 80 μm. Moreover, the dummy electrode 63 shown in FIG. 10C had a shorter diameter set to about 200 μm and a longer diameter set to about 400 μm, and a clearance between the dummy electrodes 63 was set to about 300 μm. In order to avoid a short-circuit, each of the dummy electrodes 62 and 63 was formed by only the black electrode excellent in insulating effect. A structure of the type B2 shown in FIG. 10B and a structure of the type C2 shown in FIG. 10C were fabricated as follows.

First, the black electrode was printed by a screen print method and then was dried at a predetermined temperature. In the black electrode, only the region for formation of the dummy electrode 62 or 63 was exposed previously to light in an amount of 100 to 500 mj/cm$^2$. Next, the white electrode was printed by a screen print method and then was dried at a predetermined temperature. In the white electrode, the region for formation of the dummy electrode 61 was exposed to light in an amount of 100 to 500 mj/cm$^2$. Next, these electrodes were developed with 0.1 to 10 wt % of a sodium carbonate solution and then were baked at not less than 500° C. Thus, it is possible to obtain the structures of the types B2 and C2.

Figure 11:
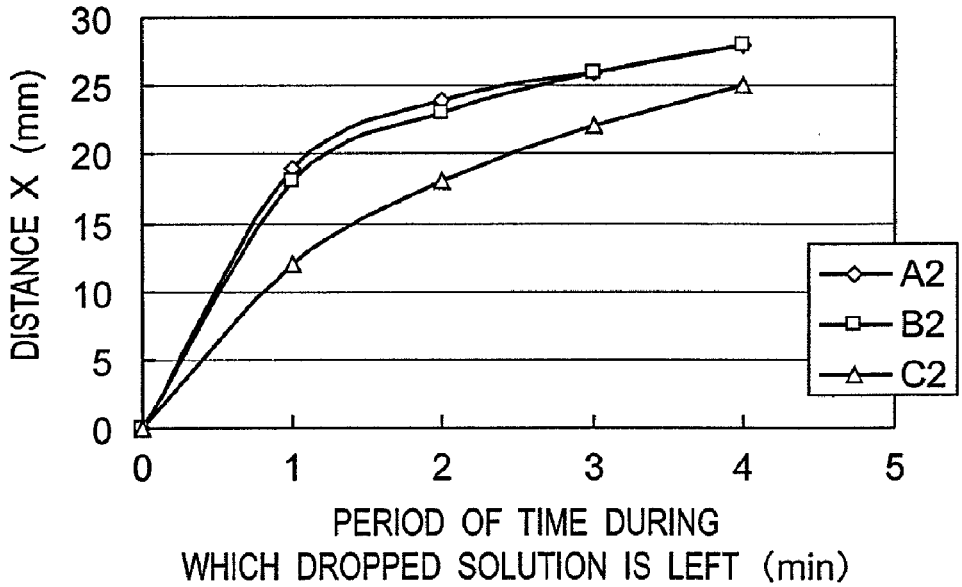
FIG. 11 is a graph showing a relation between a distance of the spread solution and a period of time during which the dropped solution is left, in the arrangements shown in FIGS. 10A to 10C.
Figure 12A:
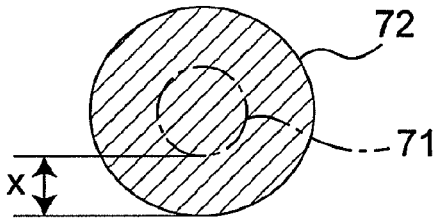
FIG. 12A is a view showing the spread of the dropped solution.
Figure 12B:
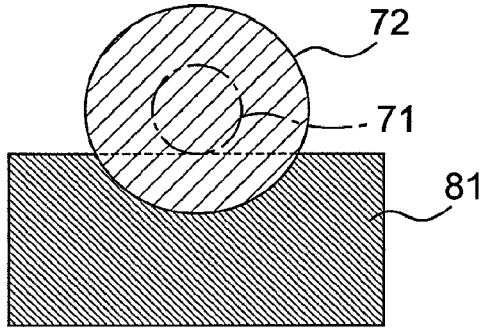
FIG. 12B is a view showing a large-area dummy electrode formed in the spreading direction of the dropped solution.
Figure 12C:
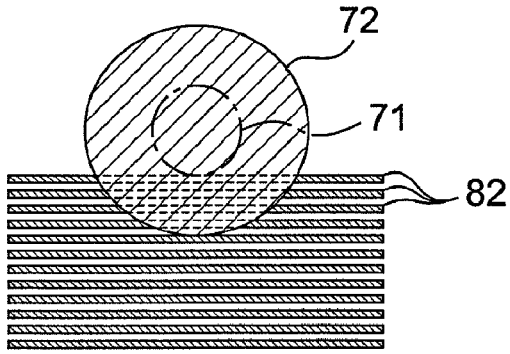
FIG. 12C is a view showing strip-shaped dummy electrodes formed in stripes in the spreading direction of the dropped solution.
Figure 12D:
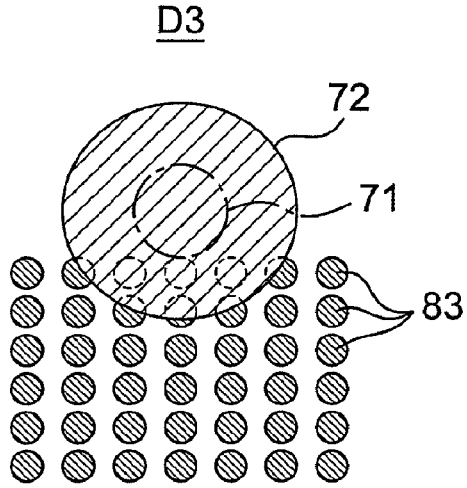
FIG. 12D is a view showing a large number of circular dummy electrodes arranged in the spreading direction of the dropped solution.

FIG. 11 is a graph showing a relation between a distance X (see FIG. 5) of the displaced sol-containing solution and a period of time during which the dropped solution is left, in the structures of the types A2 to C2.

It is apparent from FIG. 11 that the ellipsoidal dummy electrode 63 is superior to the strip-shaped dummy electrode 62 in an effect of suppressing the flow of the sol-containing solution between the dummy electrodes 61 and 61. Although not shown in FIG. 11, moreover, it is recognized that the larger number of dummy electrodes 63 enhances the effect of suppressing the flow of the sol-containing solution. Accordingly, adjustment of the number of dummy electrodes 63 allows adjustment of the flow of the sol-containing solution.

Taking the studies described above into consideration, in this embodiment, the second dummy electrode 42 formed in an ellipsoidal shape allows reduction in width of the wavy circumference of the dielectric layer 15. Moreover, the plurality of second dummy electrodes 42 allow further reduction in width of the wavy circumference of the dielectric layer 15.

Herein, the second dummy electrode 42 is formed in an ellipsoidal shape; however, the present invention is not limited thereto. As described above, in the case where the second dummy electrode 42 is equal in material and forming method to the display electrode 11, the sharpened second dummy electrode 42, for example, the second dummy electrode 42 having a rectangular shape is peeled off readily in the development step, resulting in generation of foreign matters. For this reason, preferably, the second dummy electrode 42 has a smoothly curved circumference. More preferably, the second dummy electrode 42 has a circular shape or an ellipsoidal shape. From the viewpoint of the patterning property by development, preferably, the clearance between the second dummy electrode 42 and the lead electrode 11*a* is set to not less than 30 μm. In the case where not less than two second dummy electrodes 42 are formed between the adjacent lead electrodes 11*a* and 11*a*, preferably, the clearance is set to not less than 50 μm from the viewpoint described above.

Next, the following studies were made for examining functional effects of the first to third dummy electrodes 41 to 43.

Herein, there were prepared dummy electrodes 81 to 83 of types A3 to D3 shown in FIGS. 12A to 12D. The type A3 is such that no dummy electrode is formed. The type B3 is such that the dummy electrode 81 having a large area (width: not less than 100 mm) is formed in the spreading direction of the sol-containing solution. The type C3 is such that the strip-shaped dummy electrodes 82 each having a width of 80 μm are formed in stripes with a clearance of 200 μm being interposed therebetween in a direction orthogonal to the spreading direction of the sol-containing solution. The type D3 is such that a large number of circular dummy electrodes 83 each having a diameter of about 80 μm are formed in the spreading direction of the sol-containing solution.

Figure 13:
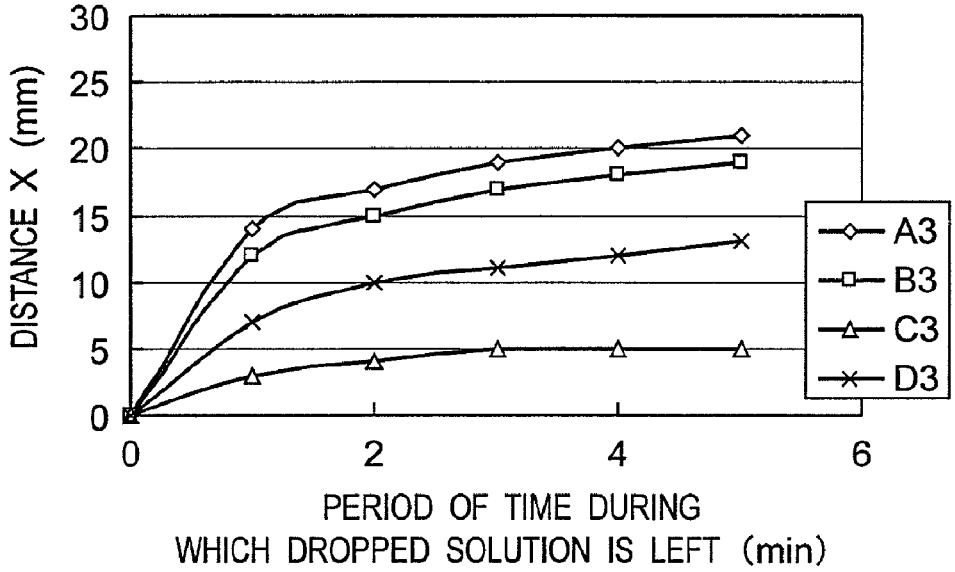
FIG. 13 is a graph showing a relation between a distance of the spread solution and a period of time during which the dropped solution is left, in the arrangements shown in FIGS. 12A to 12D.

FIG. 13 is a graph showing a relation between a distance X (see FIG. 5) of the displaced sol-containing solution and a period of time during which the dropped solution is left, in the dummy electrodes 81 to 83 of the types A3 to D3.

It is apparent from FIG. 13 that the type C3 particularly exhibits the effect of suppressing the spread of the sol-containing solution as compared with the remaining types. As described above, it is considered that the reason therefor results from a capillary phenomenon occurring at the clearance between the dummy electrodes 81 and 81. It is also apparent from FIG. 13 that the type D3 is superior to the types A3 and B3 in the effect of suppressing the spread of the sol-containing solution.

Taking the studies described above into consideration, it is preferable that the first dummy electrode 41 facilitates the flow of the sol-containing solution and therefore is not arranged in the direction orthogonal to the spreading direction of the sol-containing solution. As described above, more preferably, the sol-containing solution is apt to flow in the direction parallel with the extending direction of the dummy electrode; therefore, the first dummy electrode 41 is arranged in the direction parallel with the spreading direction of the sol-containing solution. Thus, it is possible to make the circumference of the dielectric layer 15 even.

Moreover, if the region located between the adjacent lead electrodes 11*a* and 11*a* is narrow, the strip-shaped dummy electrodes can not be formed in stripes. However, it can be understood from the studies described above that even the circular second dummy electrode 42 can satisfactorily regulate the flow of the sol-containing solution. That is, the second dummy electrode 42 prevents the sol-containing solution from excessively flowing toward the terminal group 11*b* along the lead electrode 11*a* and contributes to make the circumference of the dielectric layer 15 even.

It can also be understood from the studies described above that the third dummy electrodes 43 are formed in stripes in the direction parallel with the display electrodes 11, thereby regulating the flow of the sol-containing solution and contributing to make the circumference of the dielectric layer 15 even. Moreover, it is preferable that the number of third dummy electrodes 43 is not an order of an extremely small number such as one or two at least, as in the first dummy electrodes 41, that is, the third dummy electrodes 43 are formed in stripes over the entire non-image display region located between the display electrode 11 and the edge of the front substrate 10, the edge being extended in parallel with the display electrode 11. Herein, in the case where the third dummy electrode 43 is equal in material and forming method to the display electrode 11, preferably, the third dummy electrode 43 has a width set within a range of not less than 30 μm to not more than 150 μm, as in the first dummy electrode 41.

The effects obtained in the case where the first to third dummy electrodes 41 to 43 are formed as described above become conspicuous when the viscosity of the sol-containing solution is 5 to 100 mPa·s. More specifically, if the viscosity is not more than 5 mPa·s, there is the following possibility. That is, the sol-containing solution applied onto the front substrate 10 immediately flows on and drops from the front substrate 10 because of its low viscosity. On the other hand, if the viscosity is 100 mPa·s, there is the following advantage. That is, the width of the wavy circumference of the dielectric layer 15 can be suppressed within 4 mm without formation of the first to third dummy electrodes 41 to 43 because of the high viscosity of the sol-containing solution.

Moreover, the effects obtained in the case where the first and third dummy electrodes 41 and 43 are formed in stripes as described above become conspicuous when each of the first and third dummy electrodes 41 and 43 has a section shown in FIG. 8. Upon formation of the first and third dummy electrodes 41 and 43, if a development residue due to insufficient development is left between the dummy electrodes, the section shown in FIG. 8 can not be obtained. In consideration of the developing property, therefore, it is preferable that the clearance between the first dummy electrodes 41 and the clearance between the third dummy electrodes 43 are set to at least not less than 20 μm.

In the foregoing description, all the first to third dummy electrodes 41 to 43 are formed; however, the present invention is not limited thereto. For example, the width of the wavy circumference of the dielectric layer 15 becomes longest at the region located between the adjacent terminal groups 11*a* and 11*a*. For this reason, only the first dummy electrodes 41 can exhibit the effect of making the circumference of the dielectric layer 15 even.

Figure 14:
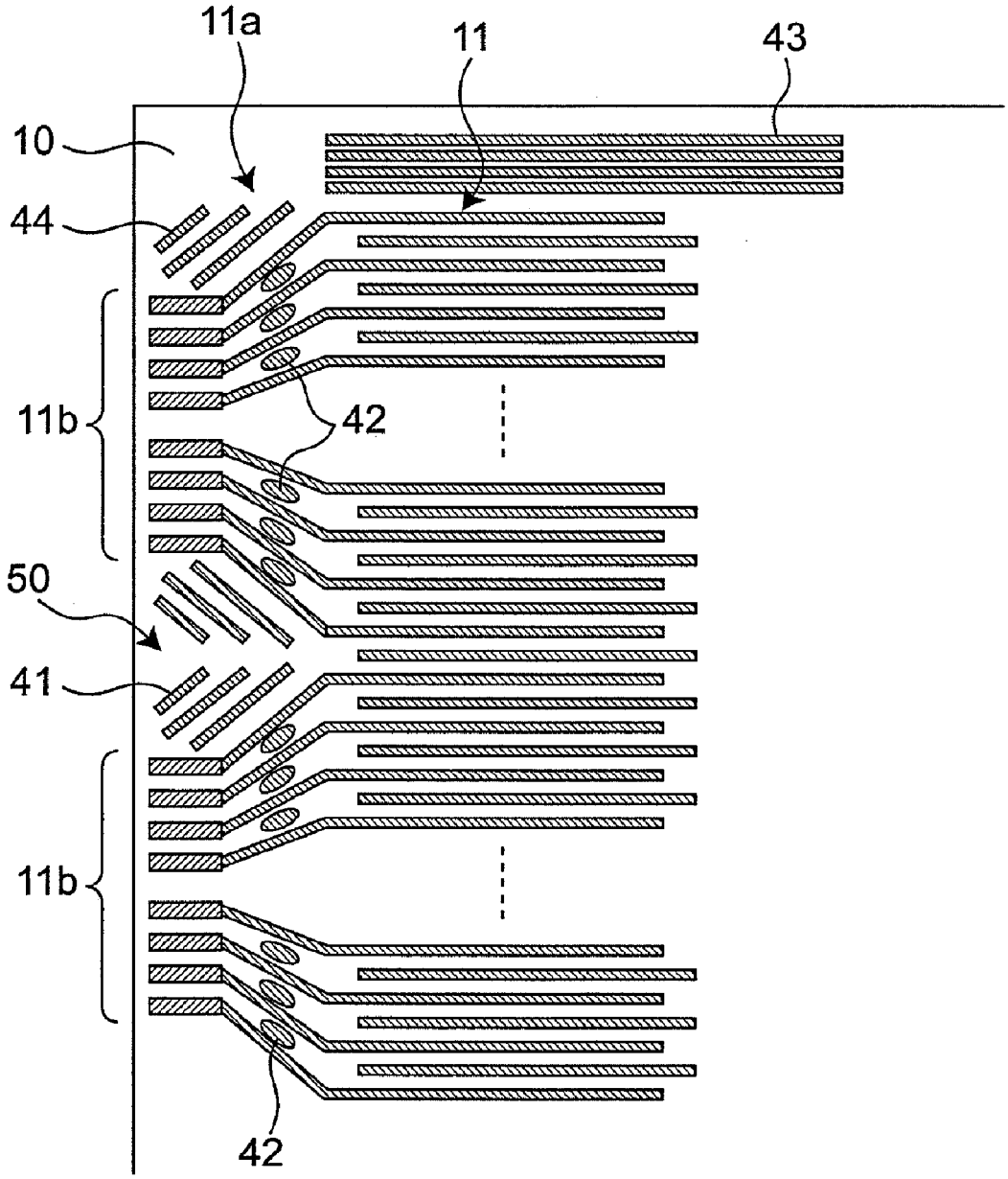
FIG. 14 is a view showing other strip-shaped dummy electrodes formed at the outer periphery of the front plate for PDP shown in FIG. 4.
Figure 15:
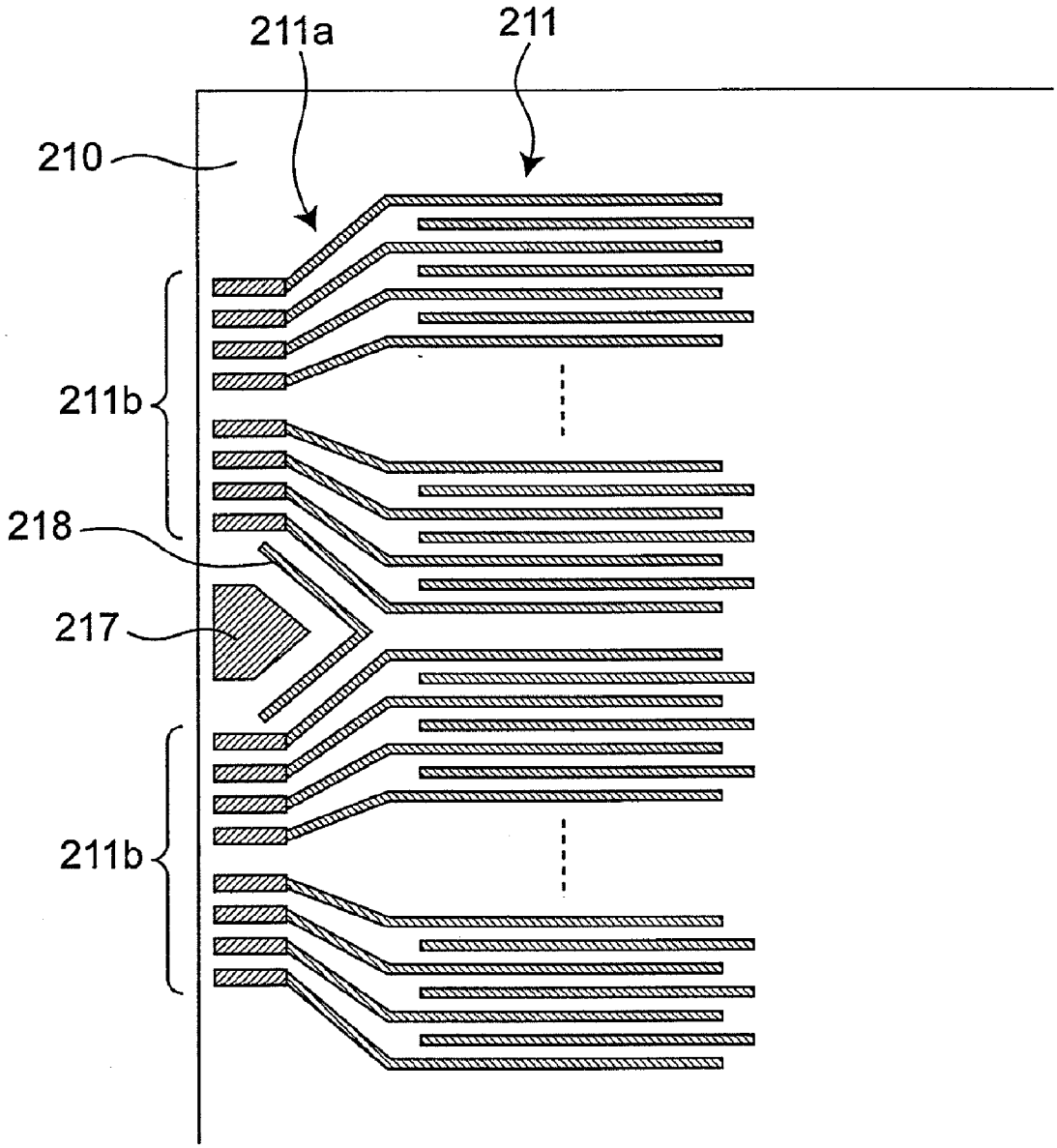
FIG. 15 is a view showing a positional relation among electrodes at an outer periphery of a front plate of a conventional PDP.
Figure 16:
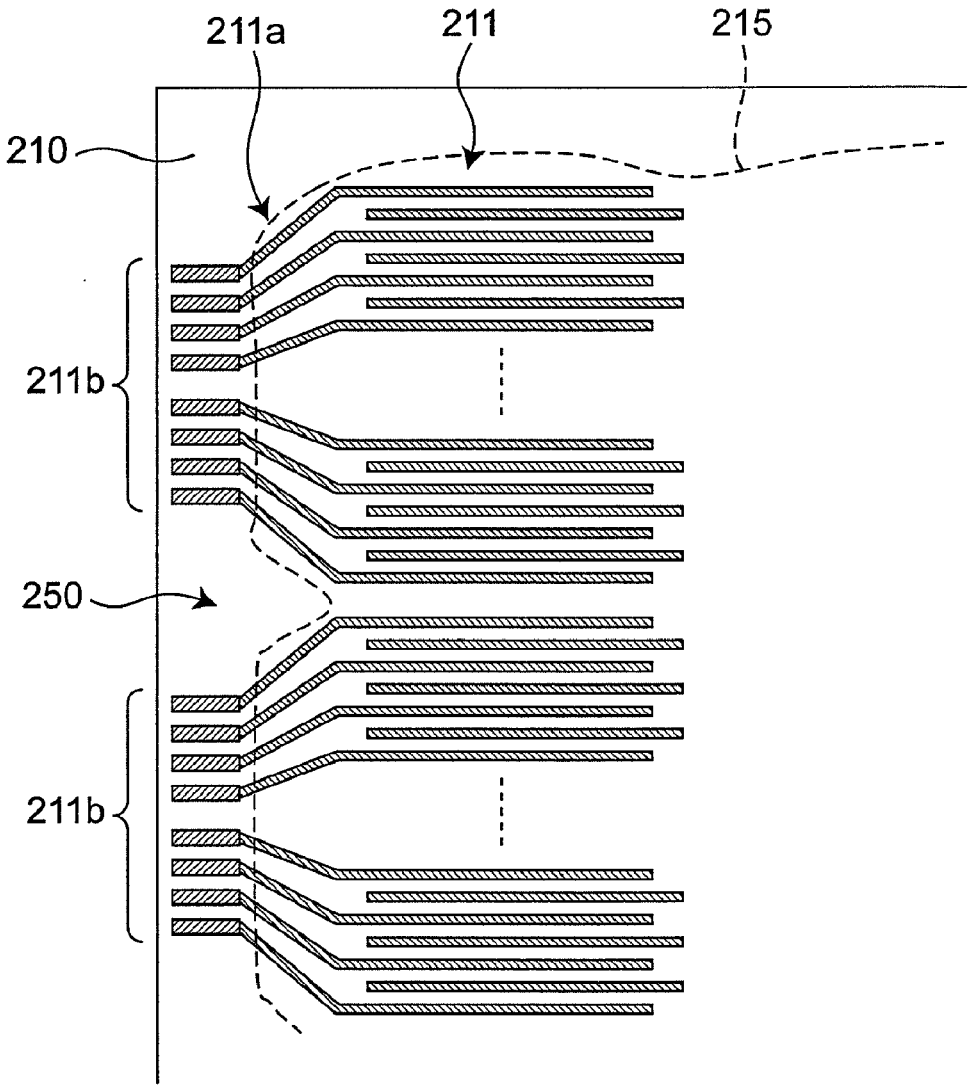
FIG. 16 is a view showing extension of a dielectric layer at an outer periphery of a front plate of a conventional PDP.

In the foregoing description, the first dummy electrodes 41 are formed at only the region 50 located between the adjacent terminal groups 11*b* and 11*b*; however, the present invention is not limited thereto. As shown in FIG. 14, for example, fourth dummy electrodes 44 may be formed between the corner of the front substrate 10 and the terminal group 11*a*. Herein, the fourth dummy electrodes 44 may be similar in number, width and arrangement clearance to the first dummy electrodes 41.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The entire disclosure of Japanese Patent Application No. 2008-031395 filed on Feb. 13, 2008, including specification, claims, drawings, and summary are incorporated herein by reference in its entirety.

The front plate for plasma display panel and the method for manufacturing the same, as well as the plasma display panel according to the present invention produce the following advantageous effect. That is, the circumference of the dielectric layer can be made even although a dielectric material to be used is low in viscosity. Therefore, the present invention is applicable to, for example, an image display device for a high-definition television set for which reduction in manufacturing cost is required.

The invention claimed is:

1. A front plate for plasma display panel, comprising:

a large number of display electrodes formed in stripes on a substrate;

a plurality of terminal groups for connection with an external drive circuit, each terminal group being formed along an edge of the substrate, the edge being extended in a direction orthogonal to an extending direction of the display electrodes, the plurality of terminal groups including adjacent first and second terminal groups;

a large number of lead electrodes extended from the display electrodes, respectively, in a non-image display region on the substrate to gather toward any one of the terminal groups without intersecting each other, the lead electrodes being connected to corresponding terminals in the relevant terminal group, respectively; and a large number of strip-shaped aid members for aiding formation of a dielectric layer in a region located between the adjacent first and second terminal groups;

wherein the lead electrodes include a pair of lead electrodes facing each other across the region between the adjacent first and second terminal groups; and wherein the aid members include a first group of aid members that are formed generally in parallel with one of the pair of lead electrodes, and a second group of aid members that are formed generally in parallel with the other of the pair of lead electrodes.

2. The front plate for plasma display panel, according to claim 1, further comprising a second aid member for aiding formation of the dielectric layer, said second aid member having a smoothly curved circumference and being formed between an adjacent pair of the lead electrodes.

3. The front plate for plasma display panel, according to claim 2, wherein the circumference of the second aid member has a circular shape or an ellipsoidal shape.

4. A plasma display panel comprising the front plate for plasma display panel according to claim 3.

5. A plasma display panel comprising the front plate for plasma display panel according to claim 2.

6. The front plate for plasma display panel, according to claim 1, further comprising a large number of strip-shaped third aid members for aiding formation of the dielectric layer, the third aid members being formed in stripes and arranged in substantially parallel with the display electrodes in a non-image display region located between the display electrodes and an edge of the substrate, the edge of the substrate being extended in a direction parallel with the extending direction of the display electrodes.

7. A plasma display panel comprising the front plate for plasma display panel according to claim 6.

8. The front plate for plasma display panel according to claim 1, wherein each of the lead electrodes has a structure in which at least two or more electrode materials are laminated.

9. A plasma display panel comprising the front plate for plasma display panel according to claim 8.

10. The front plate for plasma display panel according to claim 1, wherein the aid members are equal in material to the lead electrodes.

11. A plasma display panel comprising the front plate for plasma display panel according to claim 10.

12. The front plate for plasma display panel, according to claim 1, further comprising a dielectric layer formed on the substrate to cover the display electrodes and a part of the lead electrodes, wherein the dielectric layer has a structure of a siloxane skeleton in which an alkyl group is bonded to silicon.

13. A plasma display panel comprising the front plate for plasma display panel according to claim 12.

14. A plasma display panel comprising the front plate for plasma display panel according to claim 1.

15. The front plate for plasma display panel, according to claim 1, wherein each of the aid members is not electrically connected with either the lead electrodes or the terminal groups.

16. The front plate for plasma display panel, according to claim 15, wherein the aid members are arranged for aiding formation of the dielectric layer in the regions located between the adjacent first and second terminal groups by facilitating flow of a dielectric material during formation of the dielectric material.

17. The front plate for plasma display panel, according to claim 16, further comprising second aid members respectively formed between adjacent pairs of the lead electrodes, said second aid members each being not electrically connected with either of the lead electrodes or the terminal groups.

18. A plasma display panel comprising the front plate for plasma display panel according to claim 16.

19. The front plate for plasma display panel, according to claim 1, wherein the aid members are arranged for aiding formation of the dielectric layer in the regions located between the adjacent first and second terminal groups by facilitating flow of a dielectric material during formation of the dielectric material.

20. The front plate for plasma display panel, according to claim 19, wherein the second aid members are arranged for aiding formation of the dielectric layer by suppressing flow of dielectric material during formation of the dielectric layer.

21. The front plate for plasma display panel, according to claim 20, further comprising a large number of strip-shaped third aid members for aiding formation of the dielectric layer, the third aid members being formed in stripes and arranged in substantially parallel with the display electrodes in a non-image display region located between the display electrodes and an edge of the substrate, the edge of the substrate being extended in a direction parallel with the extending direction of the display electrodes.

22. The front plate for plasma display panel, according to claim 21, wherein each of the third aid members is not electrically connected with either of the lead electrodes or the terminal groups.

23. The front plate for plasma display panel, according to claim 22, wherein the third aid members are arranged for aiding formation of the dielectric layer by suppressing flow of dielectric material during formation of the dielectric layer.

24. A method for manufacturing a front plate for plasma display panel, the front plate including: a large number of display electrodes formed in stripes on a substrate; a plurality of terminal groups for connection with an external drive circuit, each terminal group being formed along an edge of the substrate, the edge being extended in a direction orthogonal to an extending direction of the display electrodes, the plurality of terminal groups including adjacent first and second terminal groups; a large number of lead electrodes extended from the display electrodes, respectively, in a non-image display region on the substrate to gather toward any one of the terminal groups without intersecting each other, the lead electrodes being connected to corresponding terminals in the relevant terminal group, respectively; and a large number of strip-shaped aid members for aiding formation of a dielectric layer formed in a region located between the adjacent first and second terminal groups; wherein the lead electrodes include a pair of lead electrodes facing each other across the region between the adjacent first and second terminal groups; and wherein the aid members include a first group of aid members that are formed generally in parallel with one of the pair of lead electrodes, and a second group of aid members that are formed generally in parallel with the other of the pair of lead electrodes, the method comprising forming the lead electrodes and the aid members simultaneously in such a manner that an electrode material containing a photosensitive material is exposed to light and is developed.

25. The method for manufacturing the front plate for plasma display panel, according to claim 24, wherein the front plate for plasma display panel further includes a dielectric layer formed on the substrate to cover the display electrodes and a part of the lead electrodes, and comprising forming the dielectric layer by a sol-gel method.

26. The method for manufacturing the front plate for plasma display panel, according to claim 25, comprising forming the dielectric layer by using a dielectric material having a viscosity of 5 to 100 mPa·s.

27. The method for manufacturing the front plate for plasma display panel, according to claim 24, wherein each of the aid members is not electrically connected with either the lead electrodes or the terminal groups.

28. The method for manufacturing the front plate for plasma display panel, according to claim 27, wherein the aid members are arranged for aiding formation of the dielectric layer in the regions located between the adjacent first and second terminal groups by facilitating flow of a dielectric material during formation of the dielectric material.

* * * * *